US012383016B2

(12) United States Patent
Baryudin

(10) Patent No.: US 12,383,016 B2
(45) Date of Patent: Aug. 12, 2025

(54) CYCLING HELMET WITH DETACHABLE COMPONENTS

(71) Applicant: Trek Bicycle Corporation, Waterloo, WI (US)

(72) Inventor: Alan Baryudin, Madison, WI (US)

(73) Assignee: TREK BICYCLE CORPORATION, Waterloo, WI (US)

( * ) Notice: Subject to any disclaimer, the term of this patent is extended or adjusted under 35 U.S.C. 154(b) by 93 days.

(21) Appl. No.: 18/448,373

(22) Filed: Aug. 11, 2023

(65) Prior Publication Data

US 2025/0049167 A1 Feb. 13, 2025

(51) Int. Cl.

| | |
|---|---|
| ***A42B 3/22*** | (2006.01) |
| ***A42B 3/04*** | (2006.01) |
| ***A42B 3/16*** | (2006.01) |
| ***A42B 3/32*** | (2006.01) |

(52) U.S. Cl.

CPC ..... *A42B 3/32* (2013.01); *A42B 3/0493* (2013.01); *A42B 3/16* (2013.01); *A42B 3/221* (2013.01)

(58) Field of Classification Search

CPC ..... A42B 3/32; A42B 3/0493; A42B 3/16; A42B 3/221

See application file for complete search history.

(56) References Cited

U.S. PATENT DOCUMENTS

| | | | | |
|---|---|---|---|---|
| 5,719,655 | A | 2/1998 | Peschel et al. | |
| 6,170,084 | B1 | 1/2001 | Gordon et al. | |
| 6,364,478 | B1 | 4/2002 | Jagasia | |
| 6,990,691 | B2 | 1/2006 | Klotz et al. | |
| 7,431,453 | B2 | 10/2008 | Hogan | |
| 7,568,797 | B2 | 8/2009 | Hibbs, Jr. | |
| 7,823,224 | B2 | 11/2010 | Fullerton et al. | |
| 10,070,677 | B2 | 9/2018 | Durham et al. | |
| 11,019,872 | B2 | 6/2021 | Calilung et al. | |
| 11,337,479 | B2 | 5/2022 | Kass et al. | |
| 2006/0152671 | A1 | 7/2006 | Risso et al. | |
| 2009/0049586 | A1 * | 2/2009 | Wirthenstaetter ..... | A42B 3/16 2/423 |
| 2013/0227768 | A1 | 9/2013 | Van Waes | |

(Continued)

FOREIGN PATENT DOCUMENTS

| | | | |
|---|---|---|---|
| AU | 2015264856 | A1 | 12/2015 |
| CA | 2 813 468 | C | 5/2018 |

(Continued)

*Primary Examiner* — Khoa D Huynh
*Assistant Examiner* — Erick I Lopez
(74) *Attorney, Agent, or Firm* — Bell & Manning, LLC

(57) ABSTRACT

A helmet includes a helmet anchor mounted to the helmet, and the helmet anchor includes a cavity. The helmet also includes a first magnetic element, where at least a portion of the first magnetic element is mounted within the cavity. The helmet also includes a visor. An interior surface of the visor includes a receptacle that extends therefrom. A second magnetic element is mounted within the receptacle, and the receptacle on the visor mates with the cavity of the helmet anchor to secure the visor to the helmet. The first magnetic element and the second magnetic element are attracted to one another such that the visor is detachable in response to an impact that exceeds an attractive force between the first magnetic element and the second magnetic element.

19 Claims, 15 Drawing Sheets

(56) References Cited

U.S. PATENT DOCUMENTS

| | | | | |
|---|---|---|---|---|
| 2014/0189939 | A1* | 7/2014 | Cheng | A42B 3/223 2/422 |
| 2017/0027263 | A1* | 2/2017 | Yurevich | A42B 1/247 |
| 2018/0279709 | A1 | 10/2018 | Durham et al. | |
| 2022/0095735 | A1* | 3/2022 | Castillo | A42B 3/227 |
| 2023/0130028 | A1* | 4/2023 | Grabowski | A44B 17/0076 24/303 |
| 2024/0065246 | A1* | 2/2024 | Battisti | A01K 97/06 |

FOREIGN PATENT DOCUMENTS

| | | | |
|---|---|---|---|
| CN | 212394023 | U | 1/2021 |
| CN | 216701788 | U | 6/2022 |
| DE | 100 57 473 | A1 | 11/2000 |
| DE | 10 2006 020 134 | B3 | 2/2008 |
| DE | 20 2019 001 099 | | 7/2019 |
| EP | 2 422 636 | A2 | 8/2011 |
| ES | 2 569 547 | B1 | 5/2016 |
| GB | 2 435 605 | A | 9/2007 |
| IT | MI20100822 | A1 | 7/2010 |
| TW | M365079 | U1 | 9/2009 |
| TW | M615869 | U | 8/2021 |
| WO | WO 2005/055892 | A1 | 6/2005 |
| WO | WO 2012/028743 | A1 | 3/2012 |
| WO | WO 2021/190797 | A1 | 9/2021 |

* cited by examiner

CYCLING HELMET WITH DETACHABLE COMPONENTS

BACKGROUND

A cycling helmet is often worn by bicyclists as a safety precaution to help prevent injury in the event of a cycling accident. Traditional cycling helmets come in a large variety of different shapes and can be composed of numerous different materials. Many traditional helmets include a layer of stiff foam material (e.g., expanded polystyrene) that is surrounded by a rigid outer shell. Traditional helmets can also include visors to help prevent sunlight, etc. from obstructing the wearer's vision.

SUMMARY

An illustrative helmet includes a helmet anchor mounted to the helmet, and the helmet anchor includes a cavity. The helmet also includes a first magnetic element, where at least a portion of the first magnetic element is mounted within the cavity. The helmet also includes a visor. An interior surface of the visor includes a receptacle that extends therefrom. A second magnetic element is mounted within the receptacle, and the receptacle on the visor mates with the cavity of the helmet anchor to secure the visor to the helmet. The first magnetic element and the second magnetic element are attracted to one another such that the visor is detachable in response to an impact that exceeds an attractive force between the first magnetic element and the second magnetic element.

The helmet can include a second magnetic element cover that mounts to the helmet anchor, where a base of the second magnetic element cover includes a pre-load protrusion that extends therefrom, and where the pre-load protrusion contacts the second magnetic element to help prevent movement of the second magnetic element within the helmet anchor. In one embodiment, the second magnetic element cover includes one or more clips that mount to one or more slots formed in an outer surface of the helmet anchor. In another embodiment, an interior side of a wall of the cavity is tapered to match a taper of an exterior wall of the receptacle such that the receptacle is received by and mounts within the cavity.

In one embodiment, the helmet anchor includes an extension with a plurality of slots formed in the extension. In such an embodiment, a rod is mounted to the interior surface of the visor, where the rod is sized to fit within one of the plurality of slots formed in the extension of the helmet anchor to control an angle of the visor relative to the helmet. In another embodiment, the helmet includes a second magnetic element pad that fits within the cavity of the helmet anchor, where the second magnetic element pad covers the second magnetic element to help prevent noise and to protect the second magnetic element from abrasion. One embodiment includes a fastener to secure the first magnetic element to the receptacle, where the first magnetic element includes an opening that is sized to receive the fastener. The opening in the first magnetic element can be chamfered such that the opening mates with a head of the fastener such that the fastener is flush with an end of the first magnetic element.

The helmet can also include a first magnetic element pad that is sized to cover an end of the first magnetic element and the head of the fastener. Another embodiment includes an extension with a threaded opening that extends from a bottom of the receptacle, where the threaded opening is sized to receive the fastener. In another embodiment, the visor includes a first eyewear receptacle and a second eyewear receptacle mounted to the interior surface of the visor, where each of the first eyewear receptacle and the second eyewear receptacle is configured to receive an arm of an eyewear for storage of the eyewear in the visor. In such an embodiment, the first eyewear receptacle includes a front-facing opening and a rear-facing opening, where the front-facing opening is larger than the rear-facing opening.

Another embodiment is directed to a detachable earpad assembly that mounts to the helmet, where the helmet includes a central anchor to which the detachable earpad assembly attaches. In one embodiment, the detachable earpad assembly includes a lever that has a ledge that rests upon a surface of the central anchor, where the lever is spring loaded. As such, a spring can be mounted to the lever, where a first portion of the spring rests upon an interior surface of the lever and a second portion of the spring is received by a spring receptacle formed in a cavity of a cover of the detachable earpad assembly. In one embodiment, a first anchor is mounted to the helmet, where the first anchor includes an opening that is sized to receive a post mounted to a cover of the detachable earpad assembly.

In another embodiment, an interior surface of the lever includes protrusions with through openings that are sized to receive a pivot bar. In such an embodiment, the pivot bar mounts to brackets formed within a cavity formed in a cover of the detachable earpad assembly such that the lever clips onto the detachable earpad assembly. In an illustrative embodiment, pressure applied to a bottom portion of the lever pivots the lever along the pivot bar such that the lever detaches from the central anchor for removal of the detachable earpad assembly.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Described herein are helmets that include detachable features to allow riders to customize their helmets depending on the ride conditions. One embodiment relates to a bicycle helmet visor (or alternatively a transparent face shield) that is magnetically attached to the helmet. In one implementation, the visor attaches via a magnet fixated in the visor and a ferrous steel plate housed within the helmet. Alternatively, the magnet can be mounted in the helmet housing and the steel plate can be mounted to the visor. In another alternative embodiment, a pair of magnets can be used, with a first magnet mounted in the visor and a second magnet mounted in the helmet. Regardless of the configuration, the visor is able to break free from the helmet in the event of a crash given sufficient impact energy. In some embodiments, the visor can also be removed by the user supplying sufficient force to release the magnetic attraction that holds the visor to the helmet.

The visor can also rotate up and down and be placed in a plurality of different positions relative to the helmet and the face of the user. In one embodiment, the visor has a pin that mates with a slotted arc. In rotation, the pin will clock or snap into one of a plurality of designated positions formed by slots in the slotted arc. Three slots can be used to provide three designated positions in one embodiment. Alternatively, fewer (e.g., 2) or additional slots can be used, such as 4, 5, 6, etc. to provide any desired number of designated visor positions. In another illustrative embodiment, the visor additionally has channels built into the sides that accept the arms of sunglasses and act as sunglasses storage.

In another embodiment, the helmet can include detachable ear (or cheek) pads. The use of detachable earpads allows the user to customize the helmet for different riding conditions. Removal of the earpads provides a lighter helmet with increased ventilation. The proposed embodiments can be incorporated into mountain bike helmets, urban style helmets, or any other type of athletic helmet or riding helmet.

Figure 1A:
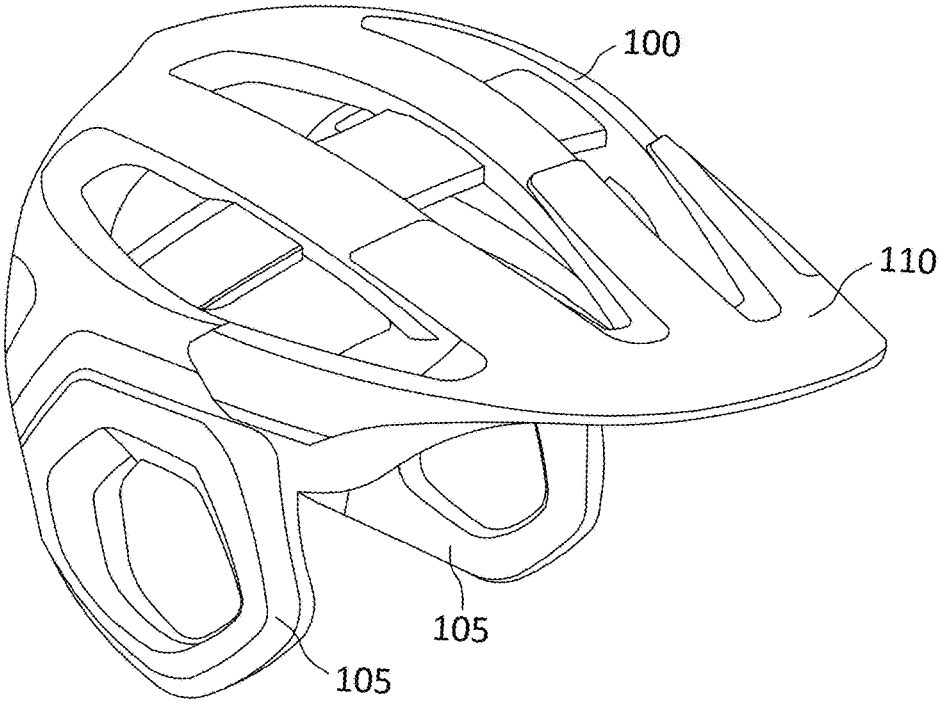
FIG. 1A is a front side perspective view of a helmet with detachable earpad assemblies and a magnetically detachable visor in accordance with an illustrative embodiment.
Figure 1B:
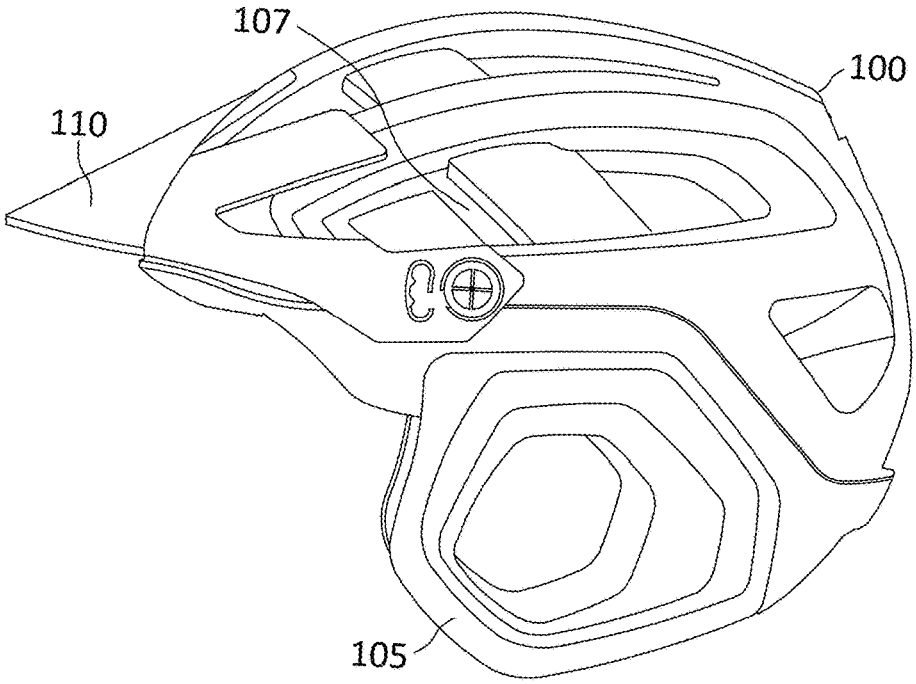
FIG. 1B is a side view of the helmet with detachable earpad assemblies and a magnetically detachable visor in accordance with an illustrative embodiment.

FIG. 1A is a front side perspective view of a helmet 100 with detachable earpad assemblies 105 and a magnetically detachable visor 110 in accordance with an illustrative embodiment. FIG. 1B is a side view of the helmet 100 with detachable earpad assemblies 105 and a magnetically detachable visor 110 in accordance with an illustrative embodiment. In the view of FIG. 1B, the magnetically detachable visor 110 is depicted as partially transparent such that the attachment of the visor to the helmet 100 can be seen. In an illustrative embodiment, the magnetically detachable visor 110 includes sunglasses storage, as discussed in more detail below.

Figure 2A:
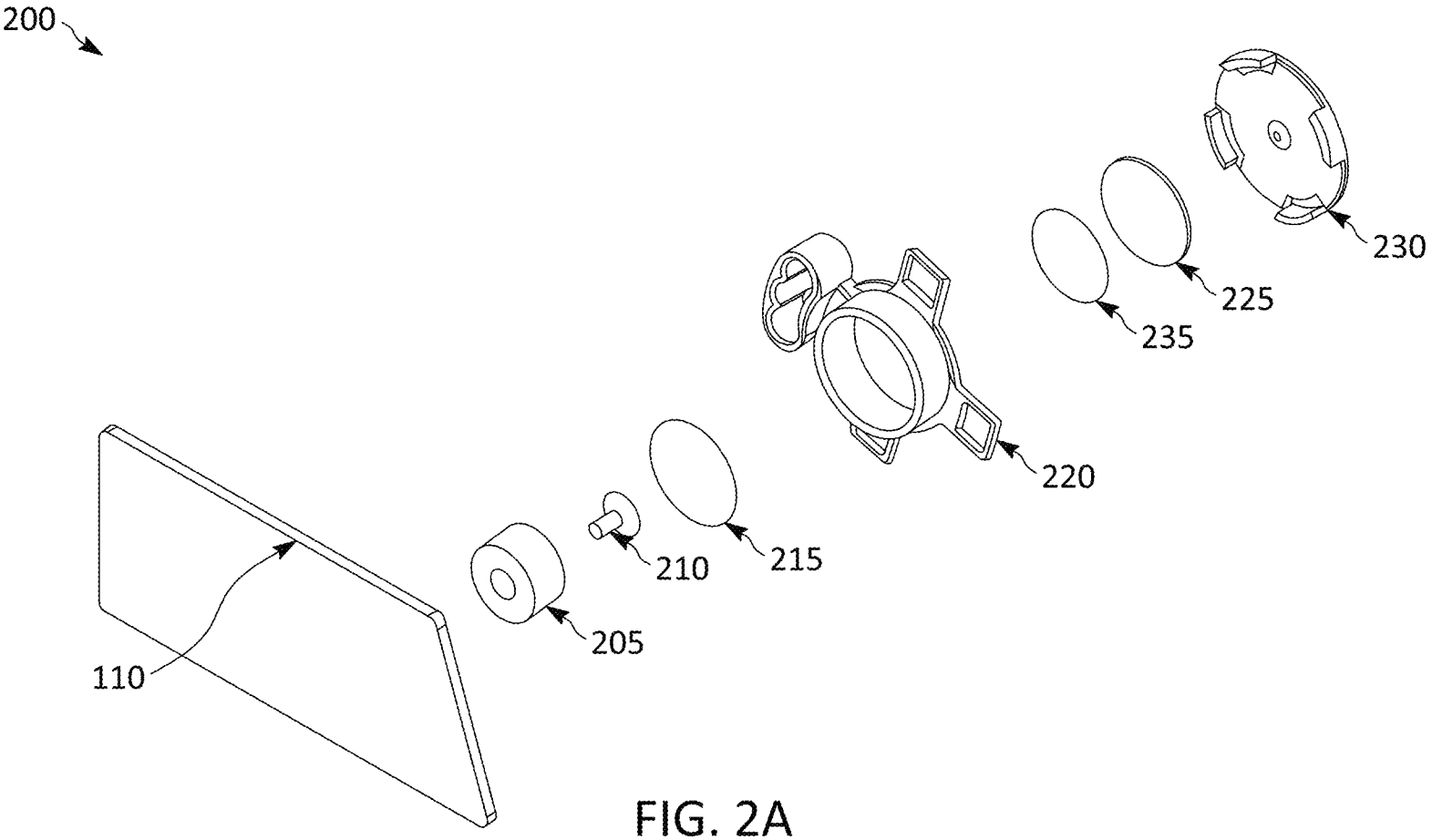
FIG. 2A is an exploded view of a magnetic assembly that is used to mount the magnetically detachable visor to the helmet in accordance with an illustrative embodiment.

FIG. 2A is an exploded view of a magnetic assembly 200 that is used to mount the magnetically detachable visor to the helmet in accordance with an illustrative embodiment. Although a single magnetic assembly is shown, it is to be understood that each side (i.e., both the right side and the left side) of the helmet and the visor includes a magnetic assembly. The magnetic assembly 200 includes components that mount to the magnetically detachable visor 110 and components that mount to the helmet 100. As shown, a first magnetic element 205 mounts to a portion of the magnetically detachable visor 110. As used herein, a magnetic element refers to a magnet or a ferrous material (e.g., plate, bar, etc.) that forms an attraction with a magnet. The depicted first magnetic element 205 is a circular magnet with a central opening that is sized to receive a fastener, such as a screw 210 to secure the first magnetic element 205 to the magnetically detachable visor 110. Alternatively, instead of a screw, a different type of fastener can be used, such as a bolt, a pin, etc.

A first magnetic element pad 215 is used to cover the first magnetic element 205 and the screw 210. In an illustrative embodiment, the first magnetic element pad 215 is an adhesive sticker that protects the surface of the first magnetic element 205 from abrasion, and also helps to prevent noise during movement of the magnetically detachable visor 110. In an alternative embodiment, the first magnetic element 205 can be a ferrous plate that forms an attraction with a magnet mounted to the helmet. In another alternative embodiment, both the visor and the helmet may include magnets that are oriented to be attracted to one another.

The magnetic assembly 200 also includes components that mount to the helmet 100. A helmet anchor 220 is embedded in the expanded polystyrene (EPS) or other material that forms an energy absorbing layer 107 of the helmet 100. A second magnetic element 225 mounts within the helmet anchor 220. In an illustrative embodiment, the second magnetic element 225 is a ferrous plate (e.g., a steel plate) that forms an attraction with the first magnetic element 205 (e.g., a magnet). Alternatively, the second magnetic element 225 can be a magnet and the first magnetic element can be a ferrous plate or another magnet, depending on the embodiment. Regardless of the configuration, there is an attraction between the first magnetic element 205 and the second magnetic element 225, and the attraction detachably secures the magnetically detachable visor 110 to the helmet 100.

Mounted to an interior-facing side of the helmet anchor 220 is a second magnetic element cover 230. As discussed in more detail below, the second magnetic element cover 230 is used to preload the second magnetic element such that the second magnetic element 225 is unable to move within the helmet anchor 220. The magnetic assembly 200 also includes a second magnetic element pad 235 that is used to cover the second magnetic element 225. In an illustrative embodiment, the second magnetic element pad 235 is an adhesive sticker that protects the surface of the second magnetic element 225 from abrasion, and also helps to prevent noise during movement of the magnetically detachable visor 110.

As discussed, in an alternative embodiment, the first magnetic element 205 (e.g., a magnet) can be positioned in the helmet anchor 220 and secured to the helmet anchor via the screw 210. In such an embodiment, the second magnetic element 225 (e.g., a ferrous plate) can mount to the interior surface of the magnetically detachable visor 110. In another alternative embodiment, the first magnetic element 205 can be a first magnet mounted to the interior surface of the magnetically detachable visor 110, and the second magnetic element 225 can be a second magnet can be mounted within the helmet anchor 220. In such an embodiment, the polarities of the magnets are oriented such that the first magnet is attracted to the second magnet and vice versa.

Figure 2B:
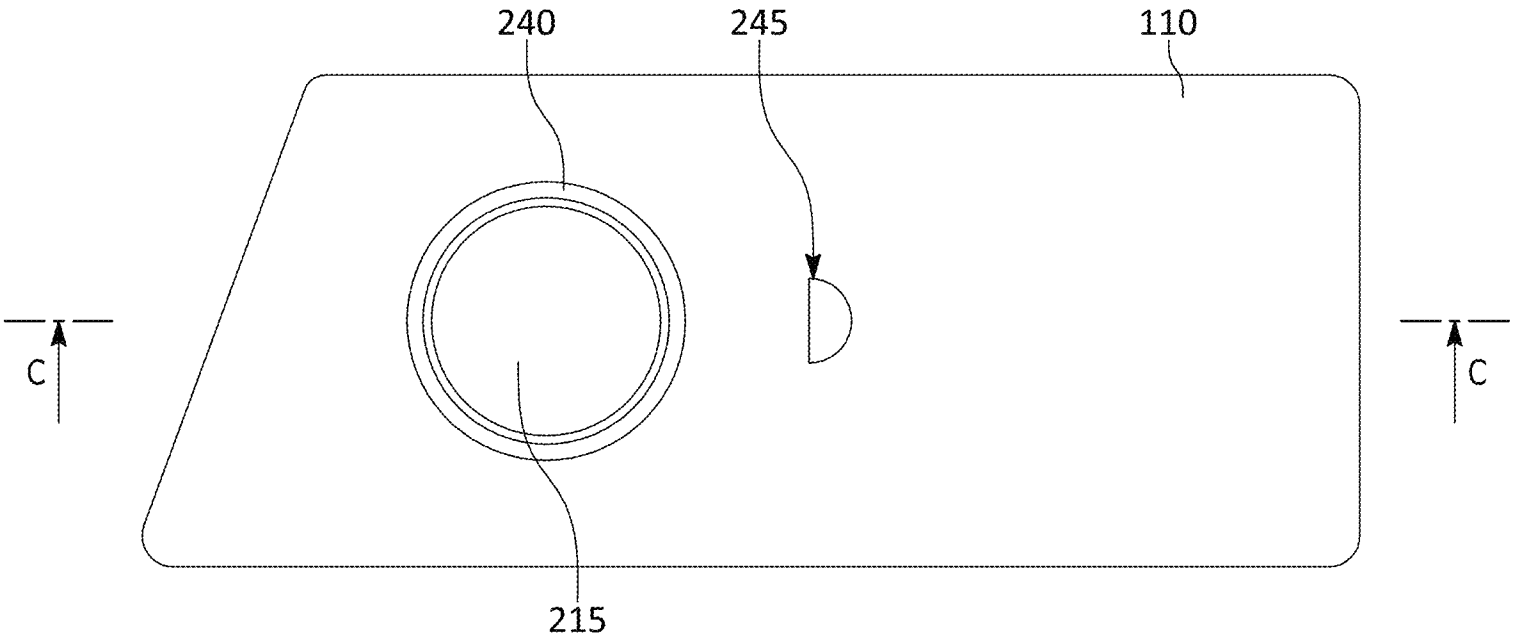
FIG. 2B is a view of an interior surface of a portion of the magnetically detachable visor that includes the magnet in accordance with an illustrative embodiment.

FIG. 2B is a view of an interior surface of a portion of the magnetically detachable visor 110 that includes the magnet in accordance with an illustrative embodiment. As shown, the interior surface of the magnetically detachable visor 110 includes a receptacle 240 that extends therefrom and that is sized to receive the first magnetic element 205 and the screw 210. An opening of the receptacle 240 is covered by the first magnetic element pad 215. Also shown on the interior surface of the magnetically detachable visor is a rod 245 that is used to position the visor at one of a plurality of positions. Specifically, the rod 245 is sized to mate with one of a plurality of slots formed in the helmet anchor 220 such that the visor can be positioned at a desired angle on the helmet. In the embodiment shown, the rod 245 has a semicircle profile. In alternative embodiments, the rod 245 can have a different profile such as circular, square, triangular, ovular, etc.

Figure 2C:
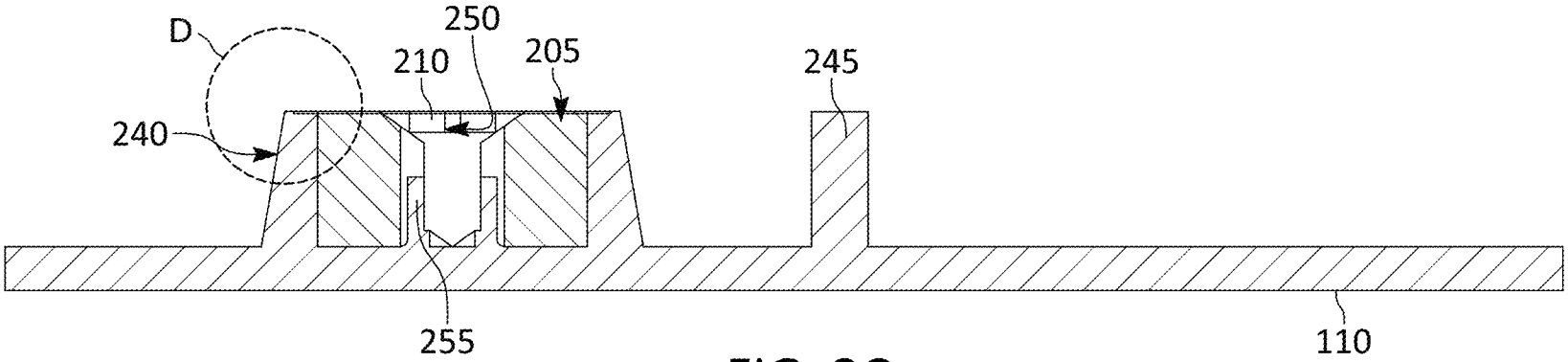
FIG. 2C is a cross-sectional view of the interior surface of a portion of the magnetically detachable visor along the sectional line of FIG. 2B in accordance with an illustrative embodiment.

As shown, FIG. 2B includes a sectional line B-B. FIG. 2C is a cross-sectional view of the interior surface of a portion of the magnetically detachable visor 110 along the sectional line of FIG. 2B in accordance with an illustrative embodiment. As shown, exterior walls of the receptacle 240 taper inward as the walls extend outward from the interior surface of the magnetically detachable visor 110. The tapered exterior walls of the receptacle 240 mate with an opening formed in the helmet anchor 220. As also shown, the opening formed in the first magnetic element 205 includes a chamfered edge 250 that mates with a tapered edge formed by the bottom of the head of the screw 210. As a result, the top of the head of the screw 210 rests flush with a top (or exterior facing edge) of the first magnetic element 205. An extension 255 with a threaded opening extends from a bottom of the receptacle 240 and is sized to receive the threads of the screw 210 or other fastener. The extension 255 is positioned within the opening in the first magnetic element 205 when the first magnetic element is mounted within the receptacle 240.

Figure 2D:
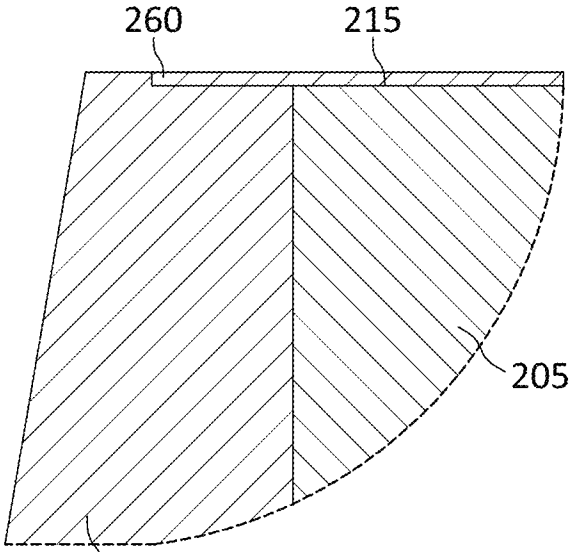
FIG. 2D is a close-up view of the magnet pad mounted to the receptacle on the interior surface of the magnetically detachable visor in accordance with an illustrative embodiment.

FIG. 2D is a close-up view of the magnet pad mounted to the receptacle 240 on the interior surface of the magnetically detachable visor 110 in accordance with an illustrative embodiment. More specifically, FIG. 2D is a close-up view of the portion of FIG. 2C that is circled. As shown, an inset 260 (or step) is formed in the top surface of the receptacle 240. A depth of the inset 260 is the same as the thickness of the first magnetic element pad 215. As a result, the first magnetic element pad 215, when mounted, rests flush with the rest of the top surface of the receptacle 240.

Figure 2E:
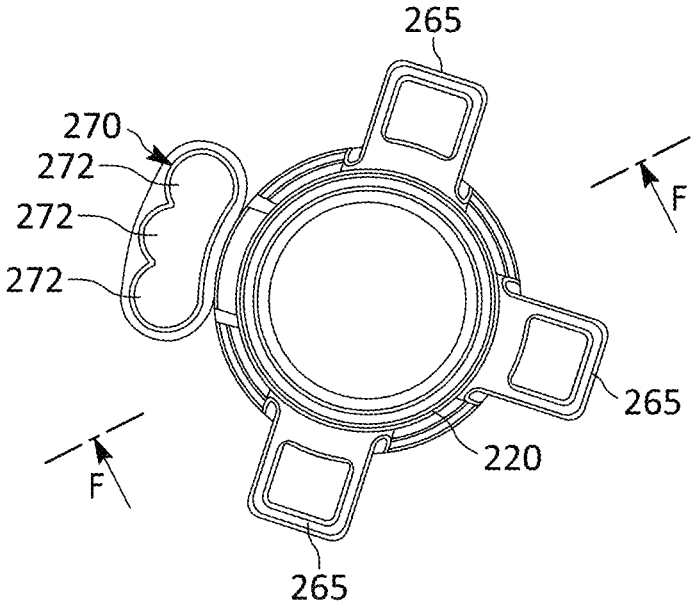
FIG. 2E is a view of the helmet anchor in accordance with an illustrative embodiment.

FIG. 2E is a view of the helmet anchor 220 in accordance with an illustrative embodiment. The helmet anchor 220 includes a plurality of tabs 265 that are used to secure the helmet anchor 220 to the energy absorbing layer of the helmet. FIG. 1B depicts the helmet anchor 220 embedded in the helmet 100. In one embodiment, the tabs 265 of helmet anchor 220 can be molded into the energy absorbing layer during formation of that layer. Alternatively, any other method of securing the helmet anchor 220 to the helmet 100 can be used, such as an adhesive.

The helmet anchor 220 also includes an extension 270 with slots 272 configured to receive the rod 245 that is attached to the interior surface of the magnetically detachable visor 110. The different slots 272 allow the user to place the magnetically detachable visor 110 at different positions on the helmet. While 3 slots 272 are shown to provide three distinct positions for the visor, in alternative embodiments a different number of slots may be used, such as 2, 4, 5, 6, etc. In another alternative embodiment, the extension 270 may not be included and the magnetically detachable visor 110 can have just a single mounting position on the helmet 100.

Figure 2F:
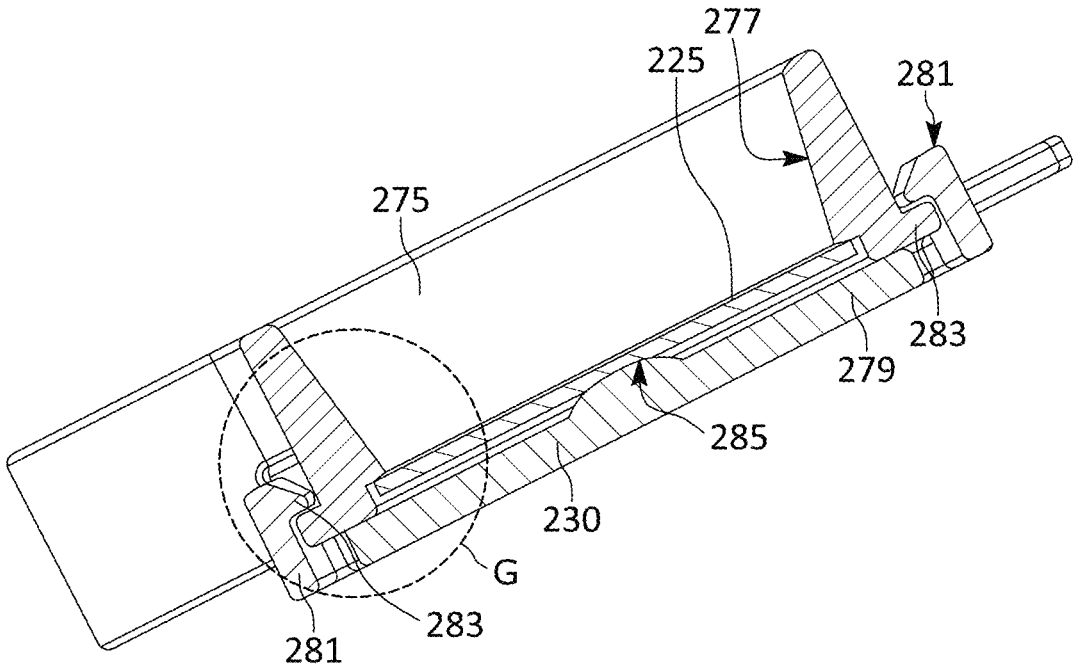
FIG. 2F is a cross-sectional view of the helmet anchor taken along the section line D-D of FIG. 2E in accordance with an illustrative embodiment.

FIG. 2F is a cross-sectional view of the helmet anchor 220 taken along the section line D-D of FIG. 2E in accordance with an illustrative embodiment. As shown, the helmet anchor 220 forms a cavity 275 that is sized to receive the tapered exterior walls of the receptacle 240 that extends from an interior surface of the magnetically detachable visor 110. Specifically, an interior side 277 of a wall of the cavity 275 is tapered to match the taper of the exterior walls of the receptacle 240 such that the receptacle 240 is received by and mounts within the cavity 275. Specifically, interior walls of the cavity 275 taper outward as the walls extend outward from the a base 279 of the helmet anchor 220.

Figure 2G:
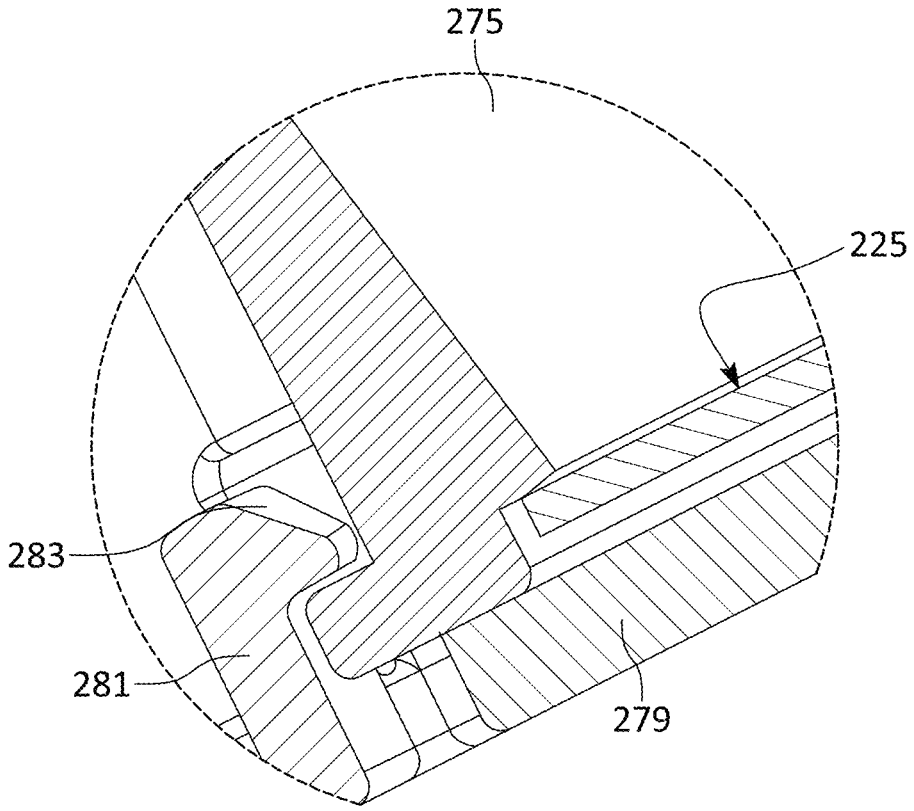
FIG. 2G is a blow-up view of the circled area in FIG. 2F in accordance with an illustrative embodiment.

The view of FIG. 2F also depicts the second magnetic element 225 and the second magnetic element cover 230 mounted to the helmet anchor 220. The second magnetic element cover 230 includes the base 279 and clips 281 attached to the base 279. As shown, the clips 281 mate with a slot 283 that is formed by and extends from an exterior side of the wall that forms the cavity 275. Additionally, a pre-load protrusion 285 extends from the base 279 of the second magnetic element cover 230 and contacts the second magnetic element 225. The pre-load protrusion 285 places force/pressure on the second magnetic element 225 to help ensure that the second magnetic element 225 does not move or rattle around during normal use of the helmet. FIG. 2G is a blow-up view of the circled area in FIG. 2F.

Figure 2H:
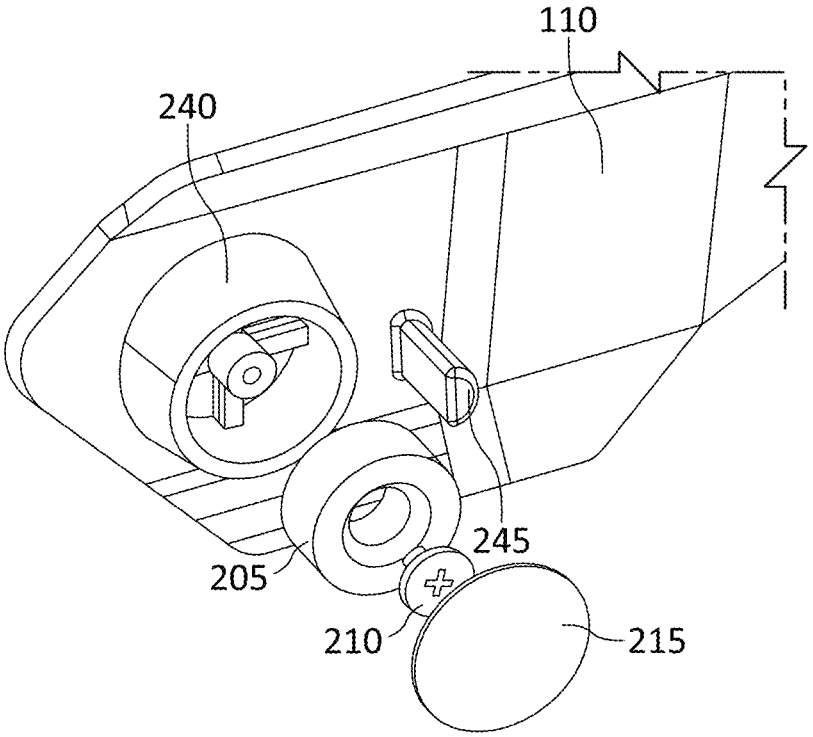
FIG. 2H is an exploded view that depicts components mounted to the magnetically detachable visor in accordance with an illustrative embodiment.

FIG. 2H is an exploded view that depicts components mounted to the magnetically detachable visor 110 in accordance with an illustrative embodiment. As shown, the receptacle 240 is mounted to the interior surface of the magnetically detachable visor 110. FIG. 2H also depicts the first magnetic element 205, the screw 210 used to secure the first magnetic element 205 to the receptacle 240, and the first magnetic element pad 215. The rod 245 that is used to position the visor at one of a plurality of positions is also shown.

Figure 2I:
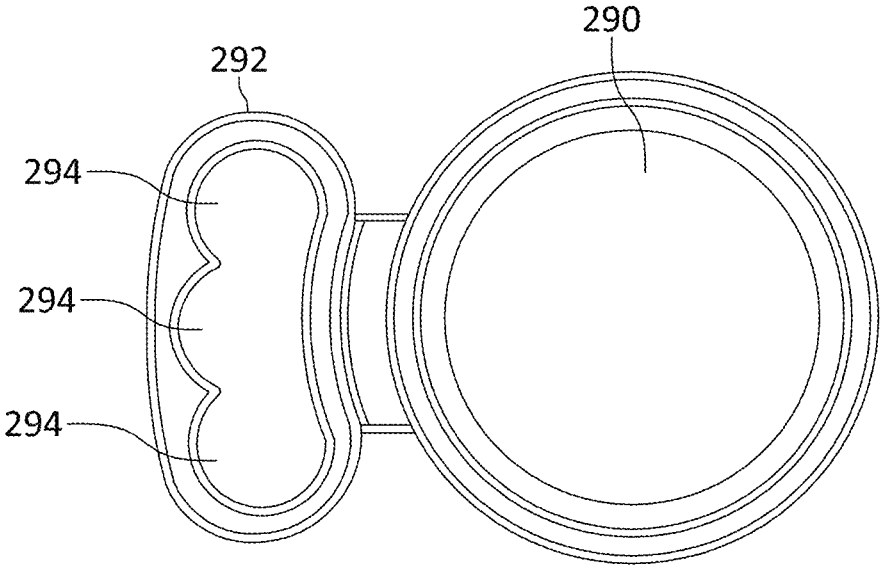
FIG. 2I depicts a helmet anchor in accordance with an illustrative embodiment.
Figure 2J:
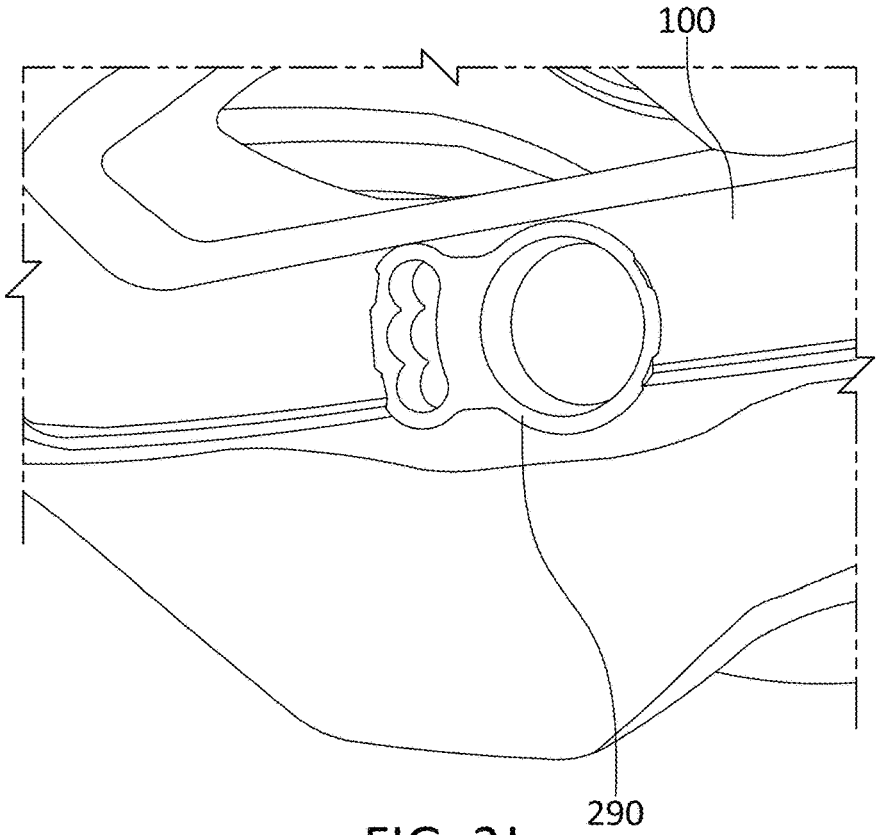
FIG. 2J is a partial view of the helmet with an embedded helmet anchor in accordance with an illustrative embodiment.
Figure 2K:
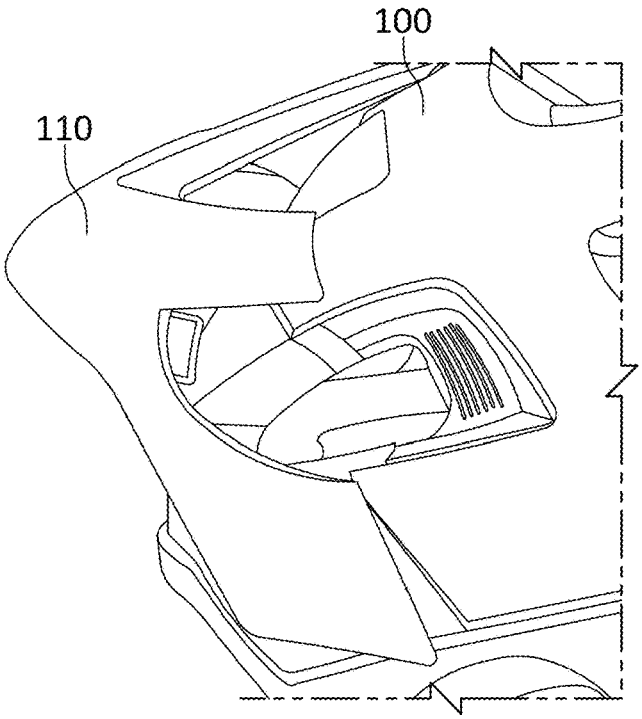
FIG. 2K depicts the magnetically detachable visor mounted to the helmet anchors of the helmet in accordance with an illustrative embodiment.

FIG. 2I depicts a helmet anchor 290 in accordance with an illustrative embodiment. The helmet anchor 290 also includes an extension 292 with slots 294 configured to receive the rod 245 that is attached to the interior surface of the magnetically detachable visor 110. The different slots 272 allow the user to place the magnetically detachable visor 110 at different positions on the helmet. While 3 slots 272 are shown to provide three distinct positions for the visor, in alternative embodiments a different number of slots may be used, such as 2, 4, 5, 6, etc. The helmet anchor 290 does not include tabs, and is secured to the helmet with an adhesive or other method that does not utilize tabs. FIG. 2J is a partial view of the helmet 100 with an embedded helmet anchor 290 in accordance with an illustrative embodiment. The view of FIG. 2J does not depict the magnetically detachable visor 110. FIG. 2K depicts the magnetically detachable visor 110 mounted to the helmet anchors of the helmet in accordance with an illustrative embodiment.

In another illustrative embodiment, the magnetically detachable visor 110 includes sunglasses (or other eyewear) storage incorporated into the visor itself. Riders will often put their sunglasses in their helmet for storage in the event that the glasses are not needed during a portion of a ride. On a traditional helmet, the sunglasses are typically put through the vents of the helmet. However, in new helmets, a different location is needed as the vents are often blocked by the underlying protective technology. Thus, described herein are eyewear ports (or receptacles) that are attached to an interior side (i.e., bottom) of the visor. As discussed below, these ports taper down as they approach the helmet in a way that directs arms of the eyewear towards the exterior of the helmet. When stored using the ports, the eyewear arms are positioned to rest over the sides of the helmet.

Figure 3A:
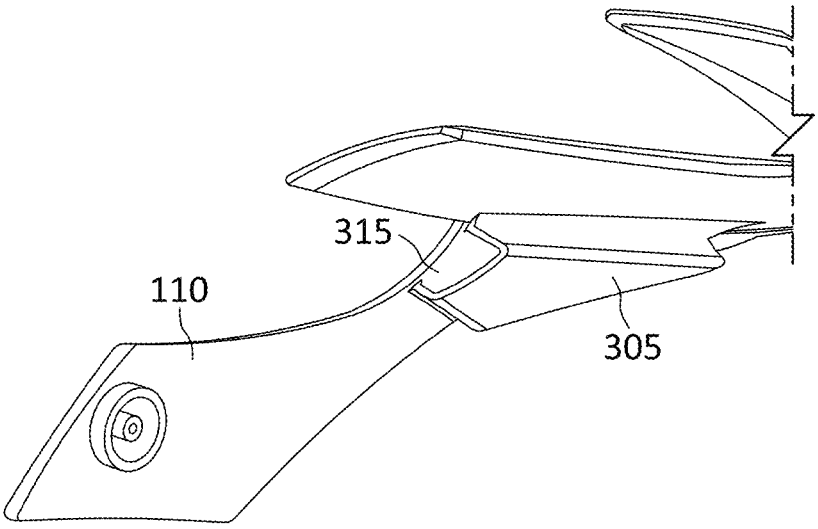
FIG. 3A is a front view of the magnetically detachable visor with built-in eyewear receptacles for securing eyewear in accordance with an illustrative embodiment.
Figure 3B:
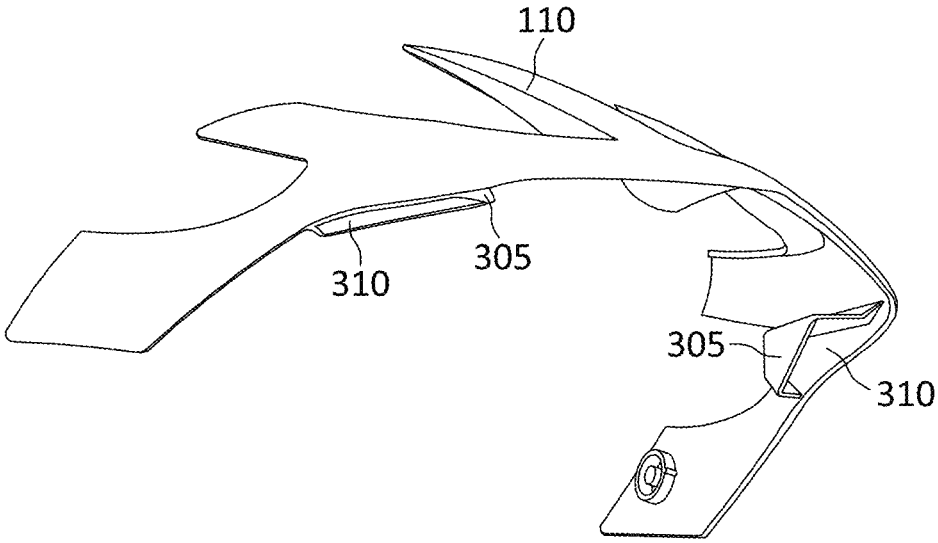
FIG. 3B is a rear view of a portion of the magnetically detachable visor that includes an eyewear receptacle in accordance with an illustrative embodiment.

FIG. 3A is a front view of the magnetically detachable visor 110 with built-in eyewear receptacles 305 for securing eyewear in accordance with an illustrative embodiment. FIG. 3B is a rear view of a portion of the magnetically detachable visor 110 that includes an eyewear receptacle 305 in accordance with an illustrative embodiment. Each of the eyewear receptacles (or ports) 305 include a front-facing opening 310 and a rear-facing opening 315. The front-facing opening 310 is larger in area than the rear-facing opening 315. As such, the eyewear receptacle 305 tapers from a larger opening (i.e., the front-facing opening 310) to a smaller opening (i.e., the rear-facing opening 315) to secure arms of the eyewear securely to the magnetically detachable visor 110. The eyewear receptacles 305 are mounted to the interior surface of the magnetically detachable visor.

Figure 3C:
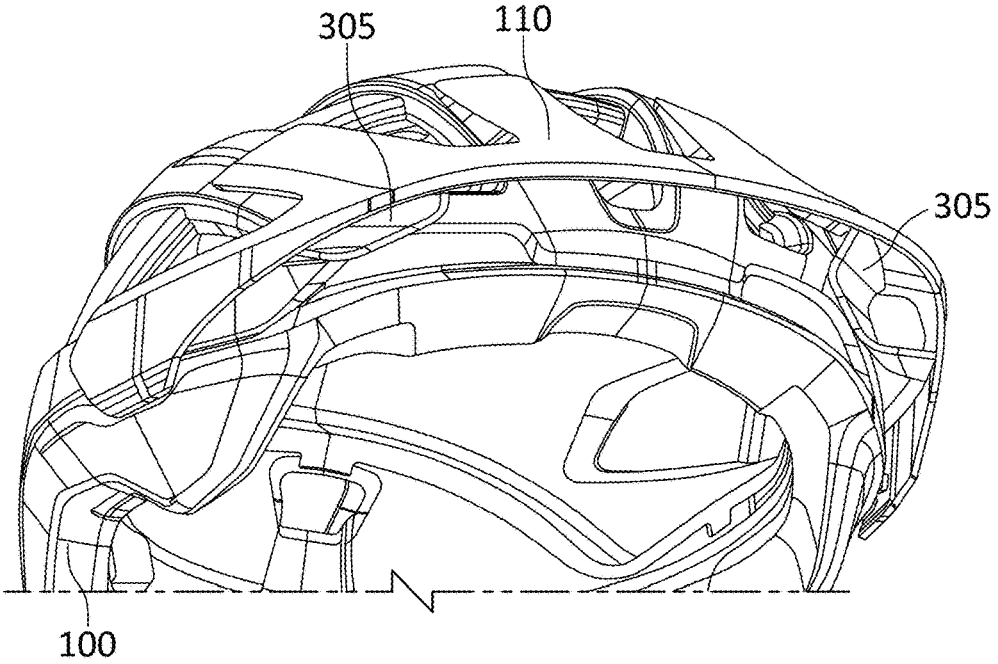
FIG. 3C is a front view of the magnetically detachable visor mounted to the helmet in accordance with an illustrative embodiment.
Figure 3D:
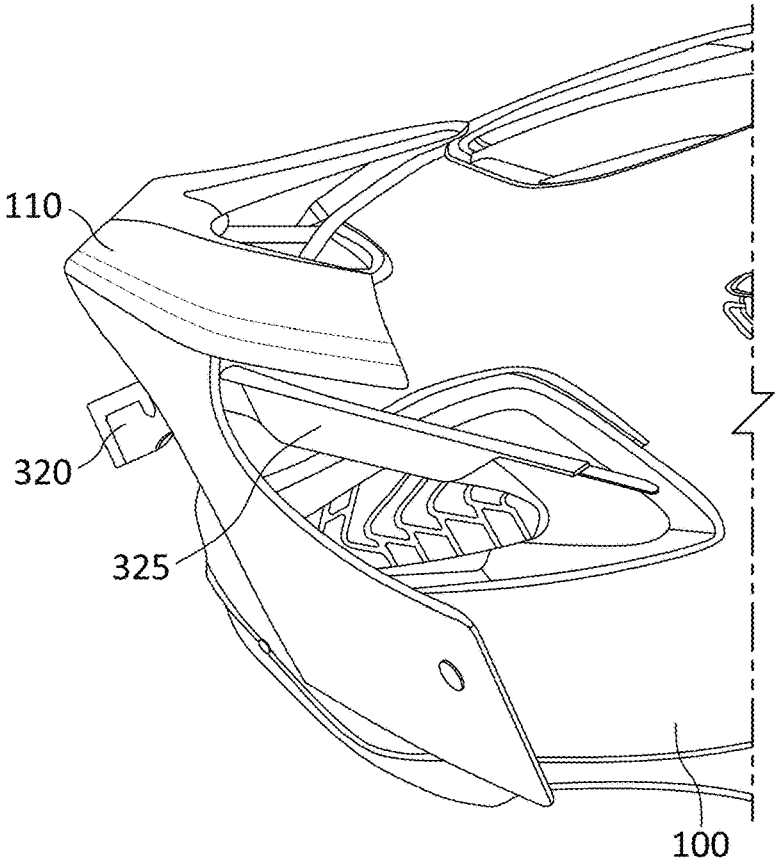
FIG. 3D is a side view of a helmet with eyewear stored in the magnetically detachable visor in accordance with an illustrative embodiment.

FIG. 3C is a front view of the magnetically detachable visor 110 mounted to the helmet 100 in accordance with an illustrative embodiment. As shown, the magnetically detachable visor 110 includes a pair of eyewear receptacles 305 that are sized to receive the arms of eyewear (e.g., sunglasses, reading glasses, etc.). FIG. 3D is a side view of a helmet with eyewear 320 stored in the magnetically detachable visor 110 in accordance with an illustrative embodiment. As shown, the arms 325 of the eyewear are received and secured by the eyewear receptacles 305. As also shown, the eyewear arms are positioned to rest over the sides of the helmet during storage. In an alternative embodiment, the magnetically detachable visor 110 may not include the eyewear receptacles 305 for eyewear storage.

Figure 4A:
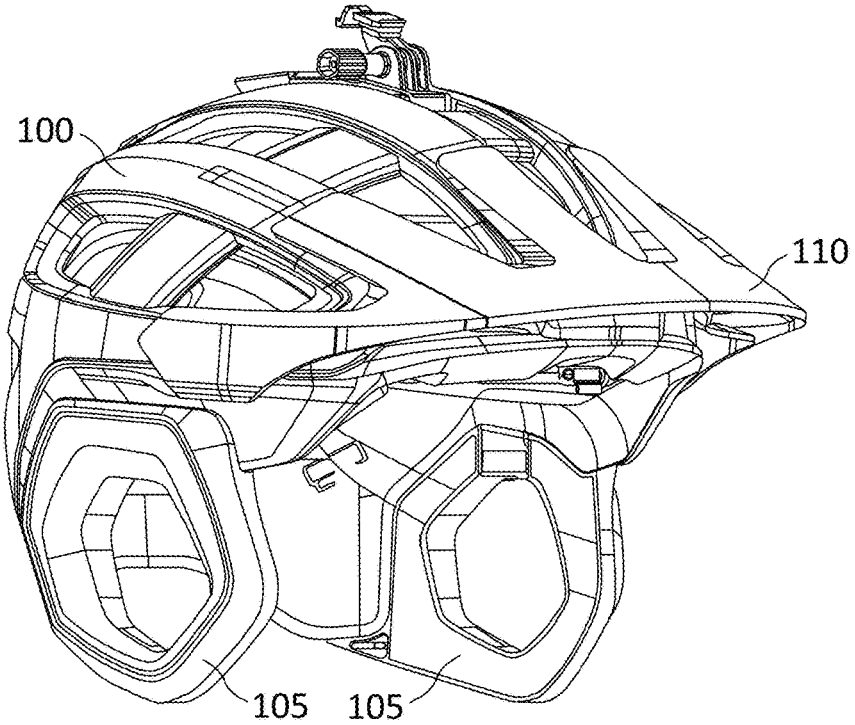
FIG. 4A depicts the helmet with the detachable earpad assemblies mounted to the helmet in accordance with an illustrative embodiment.
Figure 4B:
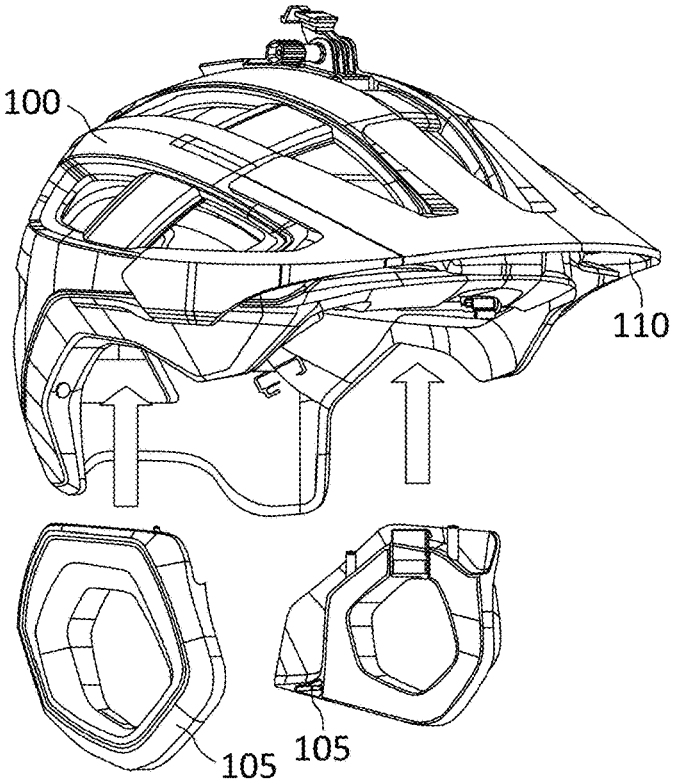
FIG. 4B depicts the helmet with the detachable earpad assemblies detached from the helmet in accordance with an illustrative embodiment.

In another illustrative embodiment, the helmet 100 includes detachable earpads such that the user is able to customize the helmet depending on the ride conditions, weather, etc. Removal of the detachable earpads results in a lighter helmet with more ventilation and airflow. FIG. 4A depicts the helmet 100 with the detachable earpad assemblies 105 mounted to the helmet in accordance with an illustrative embodiment. FIG. 4B depicts the helmet 100 with the detachable earpad assemblies 105 detached from the helmet 100 in accordance with an illustrative embodiment.

Figure 4C:
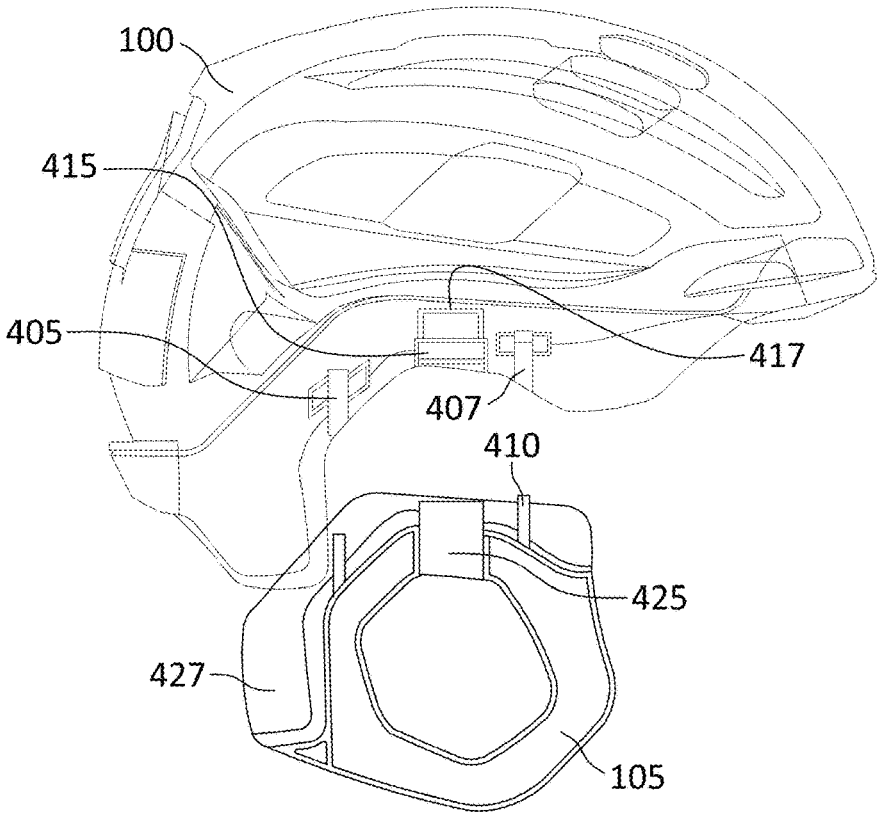
FIG. 4C is a partially transparent view of the helmet and a detached earpad assembly that depicts embedded anchors in accordance with an illustrative embodiment.
Figure 4D:
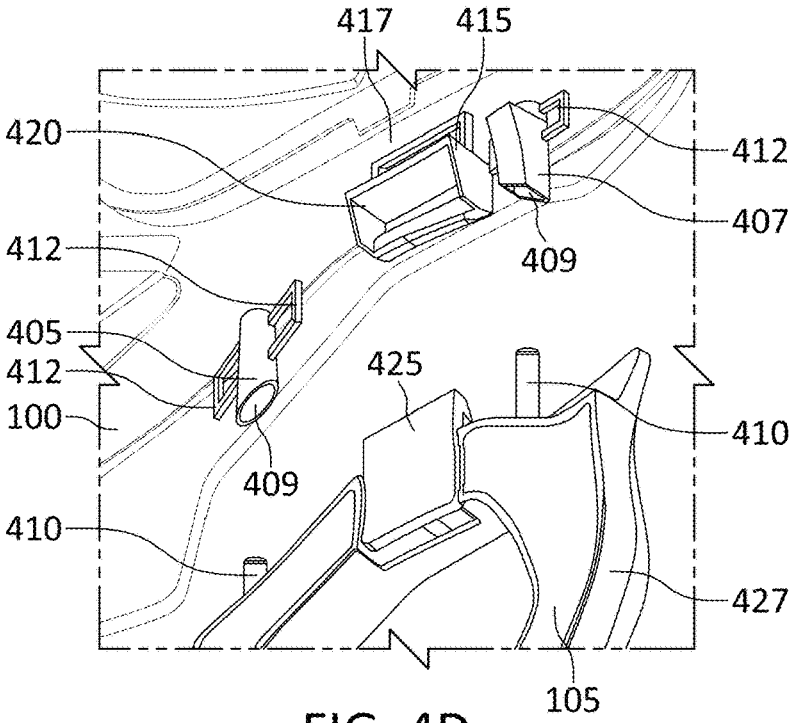
FIG. 4D is a close-up view depicting how a detachable earpad assembly mounts to the embedded anchors in accordance with an illustrative embodiment.

In an illustrative embodiment, the detachable earpad assemblies 105 are held in place by a plurality of anchors mounted within the energy absorbing layer (e.g., EPS) of the helmet. FIG. 4C is a partially transparent view of the helmet and a detached earpad assembly that depicts embedded anchors in accordance with an illustrative embodiment. FIG. 4D is a close-up view depicting how a detachable earpad assembly mounts to the embedded anchors in accordance with an illustrative embodiment. As shown, embedded in the helmet are a first anchor 405 and a second anchor 407. In an illustrative embodiment, the first anchor 405 and the second anchor 407 are identical to one another. Alternatively, the first anchor 405 and the second anchor 407 can be different from one another. The first anchor 405 and the second anchor 407 each include openings 409 that are sized and oriented to receive posts 410 that extend from an upper surface of a cover 127 of the detachable earpad assembly 105. While two anchors (405, 407) and two posts 410 are shown, in alternative embodiments a different number of mating anchors and posts may be used, such as 1, 3, 4, 5, etc. The first anchor 405 and the second anchor 407 also include tabs 412 that are used to mount the anchors within the energy absorbing layer of the helmet.

Also embedded in the energy absorbing layer of the helmet is a central anchor 415 that includes a tab 417 to secure the central anchor 415 to the helmet. The central anchor 415 also includes a receptacle 420 that is sized and shaped to receive a ledge portion of a lever 425 that is attached to the cover 427 of the detachable earpad assembly 105. In an illustrative embodiment, the lever 425 is spring-loaded and is used to control attachment and detachment of the detachable earpad assembly 105.

Figure 4E:
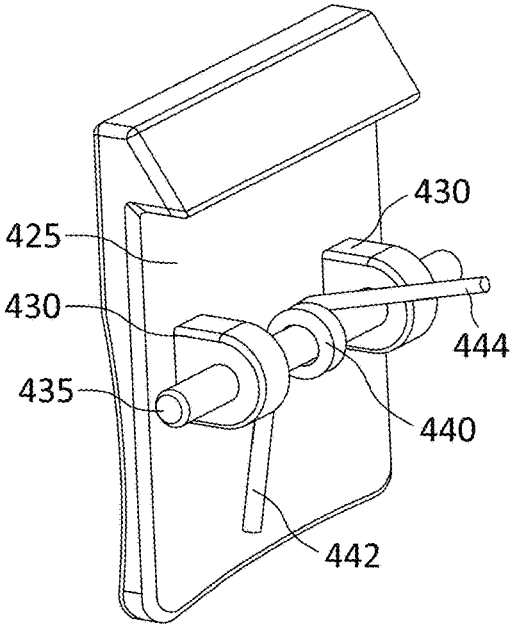
FIG. 4E is a perspective view of the lever in accordance with an illustrative embodiment.
Figure 4F:
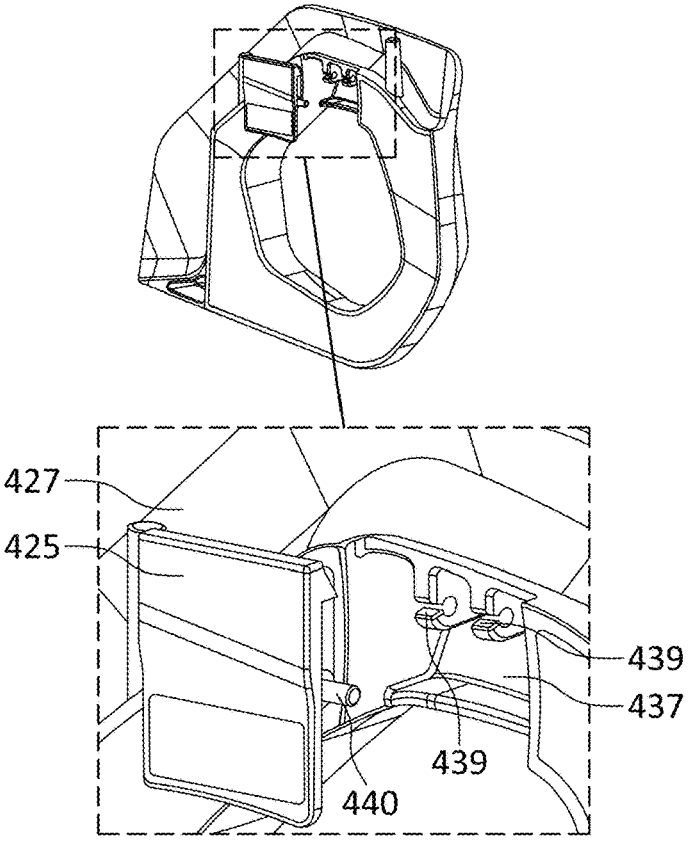
FIG. 4F includes a close-up view that depicts how the lever mounts to the cover of the detachable earpad assembly in accordance with an illustrative embodiment.

FIG. 4E is a perspective view of the lever 425 in accordance with an illustrative embodiment. FIG. 4F includes a close-up view that depicts how the lever 425 mounts to the cover 427 of the detachable earpad assembly 105 in accordance with an illustrative embodiment. As shown, an interior surface of the lever 425 includes protrusions 430 with through openings that are sized to receive a pivot bar 435. In an illustrative embodiment, the pivot bar 435 is secured by brackets 439 formed within a cavity 437 of the cover 427 such that the lever 425 clips onto the detachable earpad assembly 105. In another embodiment, the pivot bar 435 can have a length that extends past the sides of the lever 425 such that the pivot bar 435 can mate with openings formed in sidewalls of the cavity 437 of the cover 427 of the detachable earpad assembly 105. Alternatively, the lever 425 may be in-molded, glued, or otherwise connected to the cover 427 of the detachable earpad assembly 105.

Mounted to the pivot bar 435 in between the protrusions 430 is a spring 440. The spring includes a first portion 442 that is designed to rest against an interior surface of the lever 425 and a second portion 444 that extends into a spring receptacle 445 (best seen in FIGS. 4G and 4H) formed in the cavity 437 of the detachable earpad assembly 105. The spring 445 is designed to pre-load the lever 425 into a locking position such that a ledge 447 formed on the lever 425 mates with a surface of the central anchor 415 that is mounted to the helmet 100.

Figure 4G:
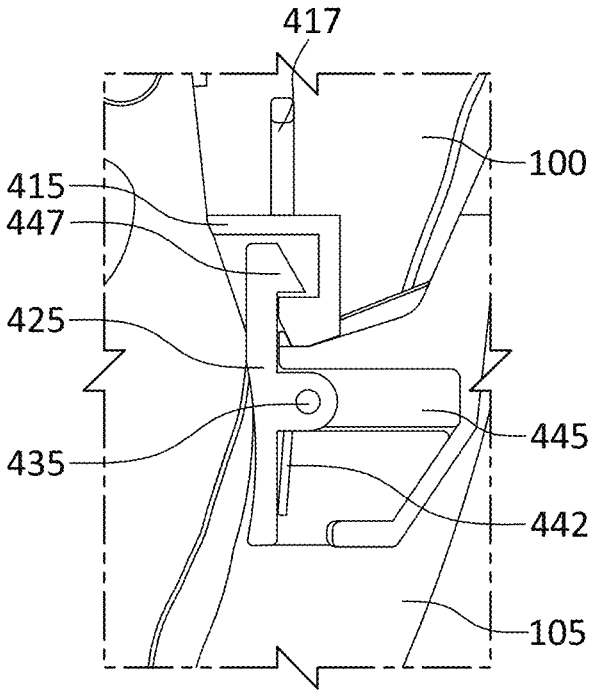
FIG. 4G depicts the lever in a locked position that secures the detachable earpad assembly to the helmet in accordance with an illustrative embodiment.
Figure 4H:
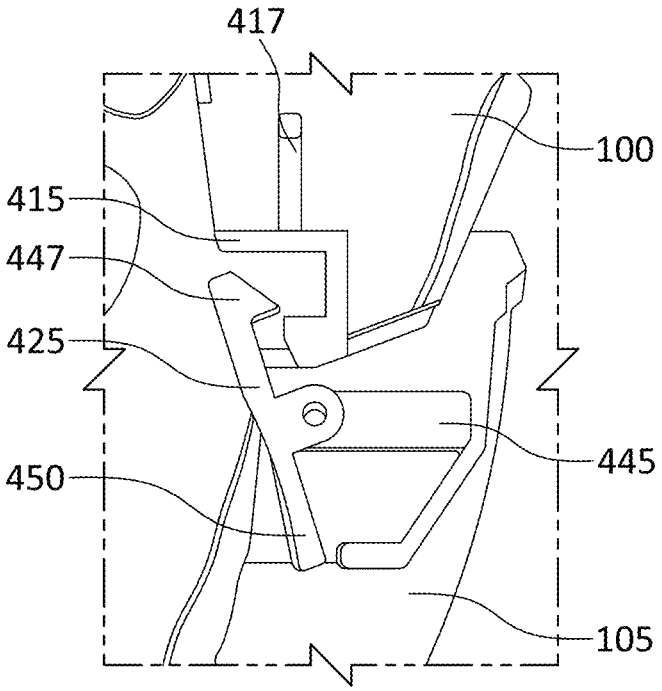
FIG. 4H depicts the lever in an unlocked position such that the detachable earpad assembly can be removed from the helmet in accordance with an illustrative embodiment.

FIG. 4G depicts the lever 425 in a locked position that secures the detachable earpad assembly 105 to the helmet 100 in accordance with an illustrative embodiment. FIG. 4H depicts the lever 425 in an unlocked position such that the detachable earpad assembly 105 can be removed from the helmet 100 in accordance with an illustrative embodiment. By pressing on a bottom portion 450 of the lever 425, the user is able to change from the secured configuration of FIG. 4G to the detachable configuration of FIG. 4H. Specifically, by pressing on the bottom portion 450 of the lever 425, the ledge 447 detaches from the surface of the central anchor 415, which allows the detachable earpad assembly 105 to be slid downward and off of the helmet 100. As the detachable earpad assembly 105 is slid down, the posts 410 slide out of the openings 409 in the first anchor 405 and the second anchor 407 such that the detachable earpad assembly 105 fully detaches from the rest of the helmet 100. When the bottom portion 450 of the lever 425 is not being pressed, the spring 440 maintains the lever 425 at an orientation in which the ledge 447 mates with the surface of the central anchor 415 to prevent removal of the detachable earpad assembly 105 (i.e., as shown in FIG. 4G).

Figure 4I:
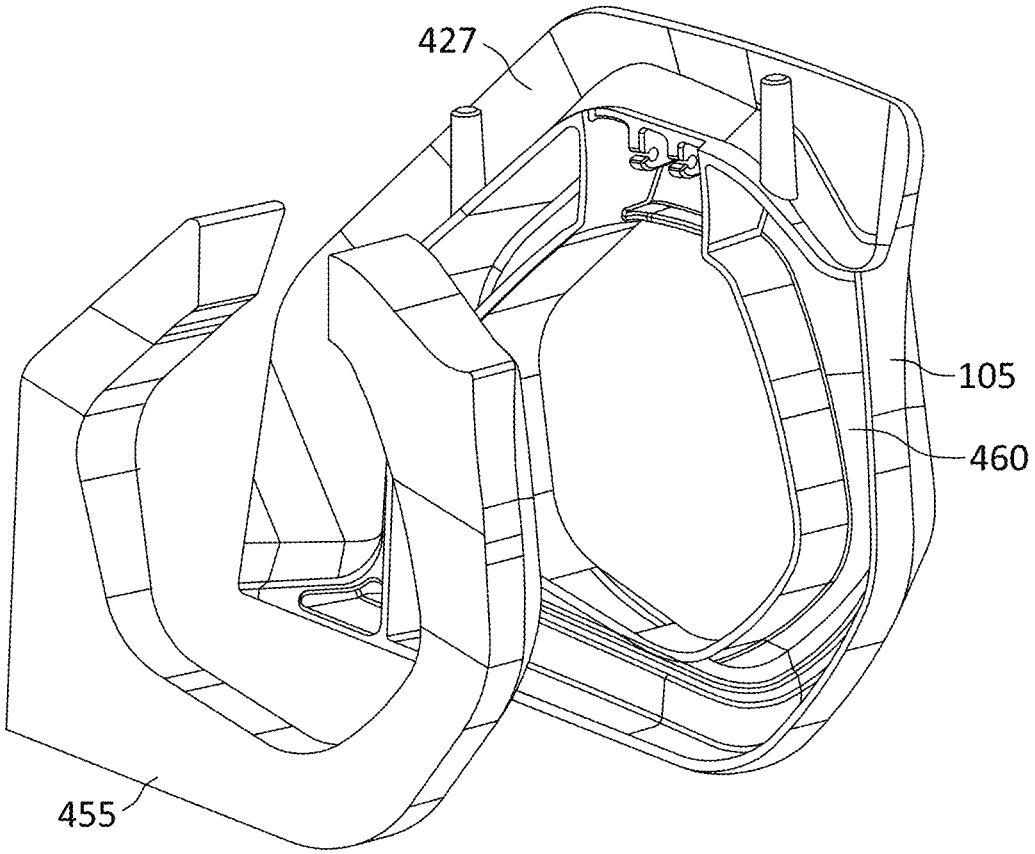
FIG. 4I shows a pad removed from the detachable earpad assembly in accordance with an illustrative embodiment.

In another illustrative embodiment, the detachable earpad assembly 105 includes a pad 455 that is removable from the cover 427 of the detachable earpad assembly 105. Alternatively, the pad 455 can be in-molded or glued into the detachable earpad assembly such that the pad 455 is not removable or replaceable. The pad 455 is used as an impact absorbing material that may attenuate impact to the area when struck. FIG. 4I shows a pad 455 removed from the detachable earpad assembly 105 in accordance with an illustrative embodiment. The pad 455 fits within a groove 460 formed in the interior surface of the cover 427 of the detachable earpad assembly 105. As noted, in some embodiments, the pad 455 can be replaced in the event of damage, or to enable the user to select different types of pads depending on his/her preference. The pad 455 can be made from expanded polypropylene (EPP), expanded polystyrene (EPS), ethylene vinyl acetate (EVA), etc.

In an illustrative embodiment, the helmets described herein can be cycling helmets. However, it is to be understood that the description is not intended to be limited to cycling helmets. For example, the helmets described herein can be used for cycling, motorcycling, rock climbing, ice climbing, skiing, snowboarding, etc.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A helmet comprising:

a helmet anchor mounted to the helmet, wherein the helmet anchor includes a cavity;

a first magnetic element, wherein at least a portion of the first magnetic element is mounted within the cavity;

a visor, wherein an interior surface of the visor includes a receptacle that extends from the interior surface;

a second magnetic element mounted within the receptacle, wherein the receptacle on the visor mates with the cavity of the helmet anchor to secure the visor to the helmet, and wherein the first magnetic element and the second magnetic element are attracted to one another such that the visor is detachable in response to an impact that exceeds an attractive force between the first magnetic element and the second magnetic element; and a cover for the second magnetic element that mounts to the helmet anchor, wherein a base of the cover for the second magnetic element cover includes a pre-load protrusion that extends therefrom, wherein the pre-load protrusion contacts the second magnetic element to help prevent movement of the second magnetic element within the helmet anchor.

2. The helmet of claim 1, wherein the cover for the second magnetic element includes one or more clips that mount to one or more slots formed in an outer surface of the helmet anchor.

3. The helmet of claim 1, wherein an interior side of a wall of the cavity is tapered to match a taper of an exterior wall of the receptacle such that the receptacle is received by and mounts within the cavity.

4. The helmet of claim 1, wherein the helmet anchor includes an extension with a plurality of slots formed in the extension.

5. The helmet of claim 4, further comprising a rod mounted to the interior surface of the visor, wherein the rod is sized to fit within one of the plurality of slots formed in the extension of the helmet anchor to control an angle of the visor relative to the helmet.

6. The helmet of claim 1, further comprising a second magnetic element pad that fits within the cavity of the helmet anchor, wherein the second magnetic element pad covers the second magnetic element to help prevent noise and to protect the second magnetic element from abrasion.

7. The helmet of claim 1, further comprising a fastener to secure the second magnetic element to the receptacle, wherein the second magnetic element includes an opening that is sized to receive the fastener.

8. The helmet of claim 7, wherein the opening in the second magnetic element is chamfered such that the opening mates with a head of the fastener such that the fastener is flush with an end of the second magnetic element.

9. The helmet of claim 7, further comprising a magnetic element pad that is sized to cover an end of the second magnetic element and the head of the fastener.

10. The helmet of claim 7, further comprising an extension with a threaded opening that extends from a bottom of the receptacle, wherein the threaded opening is sized to receive the fastener.

11. The helmet of claim 1, wherein the visor includes a first eyewear receptacle and a second eyewear receptacle mounted to the interior surface of the visor, wherein each of the first eyewear receptacle and the second eyewear receptacle is configured to receive an arm of an eyewear for storage of the eyewear in the visor.

12. The helmet of claim 11, wherein the first eyewear receptacle includes a front-facing opening and a rear-facing opening, and wherein the front-facing opening is larger than the rear-facing opening.

13. The helmet of claim 1, further comprising a detachable earpad assembly that mounts to the helmet, wherein the helmet includes a central anchor to which the detachable earpad assembly attaches.

14. The helmet of claim 13, wherein the detachable earpad assembly includes a lever that has a ledge that rests upon a surface of the central anchor, and wherein the lever is spring loaded.

15. The helmet of claim 14, further comprising a spring mounted to the lever, wherein a first portion of the spring rests upon an interior surface of the lever and wherein a second portion of the spring is received by a spring receptacle formed in a cavity of a cover of the detachable earpad assembly.

16. The helmet of claim 14, wherein an interior surface of the lever includes protrusions with through openings that are sized to receive a pivot bar.

17. The helmet of claim 16, wherein the pivot bar mounts to brackets formed within a cavity formed in a cover of the detachable earpad assembly such that the lever clips onto the detachable earpad assembly.

18. The helmet of claim 17, wherein pressure applied to a bottom portion of the lever pivots the lever along the pivot bar such that the lever detaches from the central anchor for removal of the detachable earpad assembly.

19. The helmet of claim 13, further comprising a first anchor mounted to the helmet, wherein the first anchor includes an opening that is sized to receive a post mounted to a cover of the detachable earpad assembly.

* * * * *